US005791615A

United States Patent [19]

Joubran

[11] Patent Number: 5,791,615

[45] Date of Patent: Aug. 11, 1998

[54] SLIDE BAR ASSEMBLY

[75] Inventor: Raymond Joubran, Pasadena, Calif.

[73] Assignee: Interbath, Inc., City of Industry, Calif.

[21] Appl. No.: 548,701

[22] Filed: Oct. 26, 1995

[51] Int. Cl.[6] ..... A47F 1/10

[52] U.S. Cl. ..... 248/295.11; 248/223.4

[58] Field of Search ..... 248/295.11, 223.41, 248/225.11, 227.3, 312, 312.1, 314, 219.3

[56] References Cited

U.S. PATENT DOCUMENTS

| | | | |
|---|---|---|---|
| 3,939,986 | 2/1976 | Pierro | 248/231.41 |
| 4,438,604 | 3/1984 | McGourty, Jr. et al. | 248/223.41 |
| 5,188,327 | 2/1993 | White | 248/314 |
| 5,249,881 | 10/1993 | Austin, Jr. et al. | 403/109 |
| 5,277,391 | 1/1994 | Haug et al. | 248/295.11 |
| 5,356,107 | 10/1994 | Sinohuiz | 248/223.41 |
| 5,386,961 | 2/1995 | Lu | 248/223.41 |

*Primary Examiner*—Ramon O. Ramirez
*Assistant Examiner*—Willie Berry, Jr.
*Attorney, Agent, or Firm*—Graham & James LLP

[57] ABSTRACT

A slide bar assembly for holding one or more containers or other items is provided. The assembly includes an adaptor that slides along a cylindrical or rectangular bar. The adaptor slides along the bar by using one of two bores disposed in the adaptor. The bores are displaced from each other by a fixed angular distance. When a container or other item is placed on the opposite end of the adaptor, the item is held in place. When the adaptor is lifted, it can easily slide along the bar to various positions.

15 Claims, 1 Drawing Sheet

FIG. 1
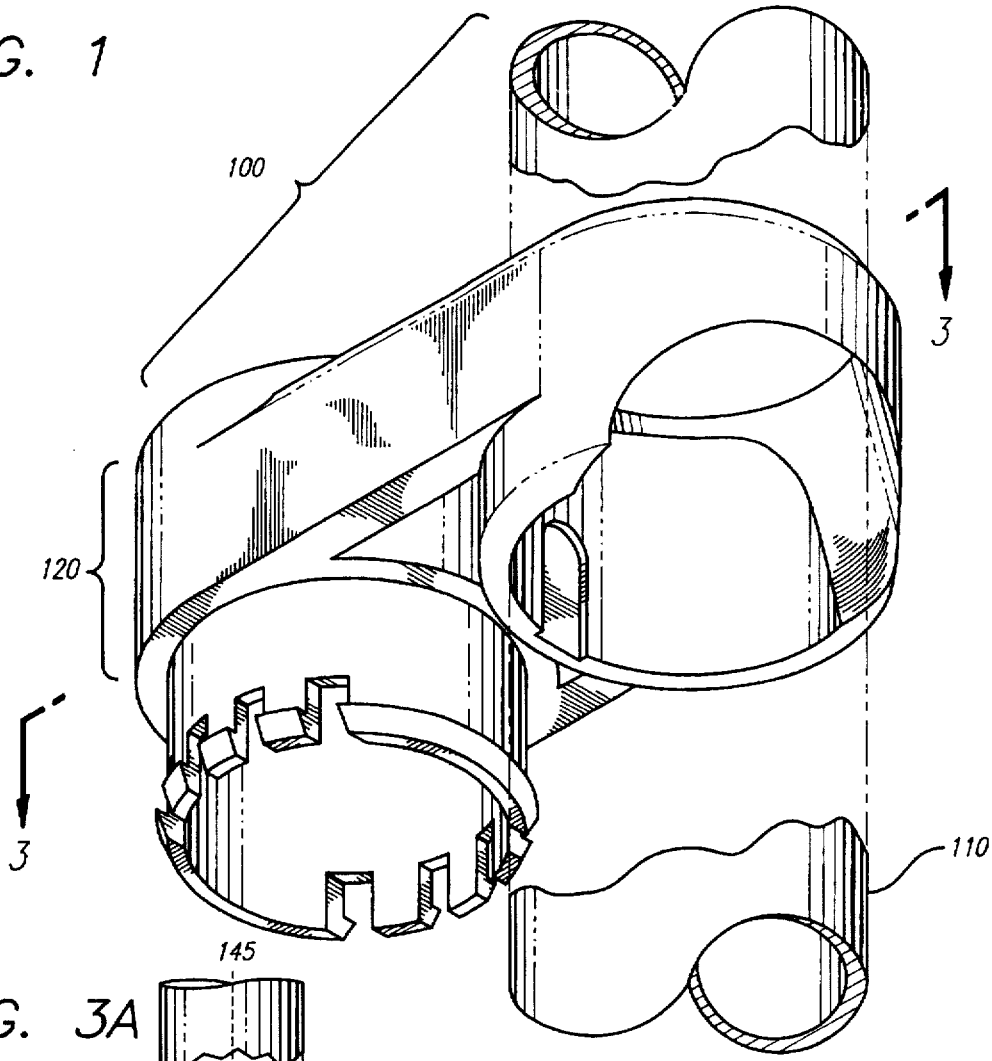
FIG. 3A
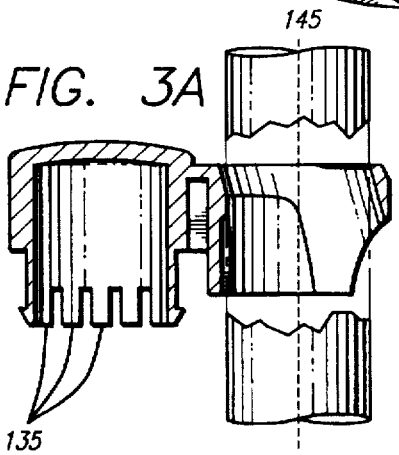
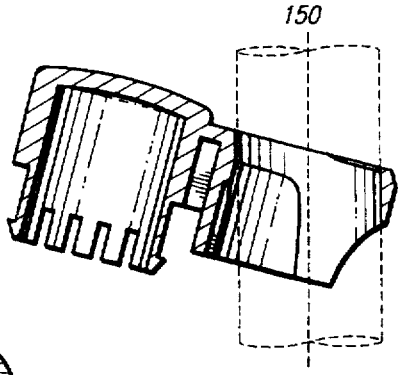
FIG. 3B
FIG. 2
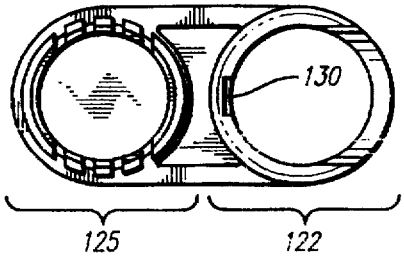

SLIDE BAR ASSEMBLY

BACKGROUND OF THE INVENTION

1. Field of the Invention

The present invention relates to a slide bar assembly. More particularly the assembly allows users to slide a container or group of containers along a bar for storage of personal items. Applications for the assembly include the storage of various shower accessories, such as a soap dish or towel hook, along a shower bar.

2. Background

A vast variety of methods for storage of personal items are well-known. Among these methods of storing personal items is a bar assembly. In a bar assembly, a bar is mounted along a wall or other structure. Storage containers or holders are then coupled to an adaptor that slides along the bar. One example of a bar assembly is the shower bar. A shower bar is often mounted along a wall of the shower. A shower head, soap dish, towel rack, or shampoo holder can then be attached to the adaptor and stored along the bar. Thus, a bar of soap, a towel, and other shower items become easily accessible during the shower or bath.

Commonly, the slide bar is cylindrical. An adaptor having an aperture can thereby be slidably attached to the bar. Several items may be simultaneously stacked along the bar in this manner. Once a certain fixed capacity has been reached, no further containers or holders may be stored on the bar.

To ensure that the storage container or other holder and the corresponding adaptor remain affixed to the bar, various adhesives may be used. These adhesives, however, limit the ability of the adaptor to slide along the bar. Once an item has been coupled to the adaptor and affixed to the bar, it cannot be easily removed. Thus, the user lacks flexibility in choosing the point along the bar where items are to be stored.

Attempts to use temporary locking mechanisms on the bar assembly have similarly proven unsuccessful. Most of these known devices require the user to exert a great deal of effort to adjust and move the adaptor along the bar. The adaptor is often difficult to remove and its operation and installation are complicated.

Accordingly, a need exists for a bar assembly which allows containers or holders to be easily moved to various points along the bar.

SUMMARY OF THE INVENTION

The present invention is directed to a slide bar assembly having an improved locking feature that allows an adaptor to easily move along a bar and lock in place where necessary.

In particular, the slide bar assembly of the present invention preferably employs an elongated bar member and an adaptor. The adaptor includes a slider having two bores disposed therein. The first bore is disposed vertically through the adaptor. The second bore is offset from the first bore by a predetermined angular distance. The adaptor can slide along the bar via either bore. When an item is attached to the holder portion of the adaptor, however, the adaptor locks in place by the weight of the holder. An elastomer strip may also be used to increase the amount of friction between the adaptor and the bar in the locked position. To move the item along the bar, the user lifts the item, thereby causing the second bore to align with the bar. With the second bore aligned, the adaptor can be moved up and down along the bar.

In a second embodiment, a generally rectangular bar member is utilized. The bar member includes longitudinally elongated indentations along both its side edges. The adaptor has a generally U-shaped retaining member which mates with the bar member. In particular, the adaptor includes protrusions from inner surfaces of the respective opposite legs of the retaining member. In addition, interference ribs may also protrude from the inner edge of the adaptor. The protrusions mate with the indentations and are used to slide the adaptor along the bar. The interference ribs create friction in order to lock the adaptor in a particular position relative to the bar. When the adaptor is lifted from a locked position, the adaptor can easily slide along the bar. The interference ribs also produce an audible click to indicate that the adaptor has been displaced from the locked position.

A more complete understanding of the slide bar assembly will be afforded to those skilled in the art, as well as a realization of additional advantages and objects thereof, by a consideration of the following detailed description of the preferred embodiment. Reference will be made to the appended sheets of drawings which will first be described briefly.

BRIEF DESCRIPTION OF THE DRAWINGS

FIG. 1 is a perspective view of the slide bar assembly of the present invention.

FIG. 2 is a bottom view thereof;

FIG. 3A is a side cut-away view thereof;

FIG. 3B is a side cut-away view thereof showing the adaptor in a raised position;

FIG. 4 is perspective view of a second embodiment of the present invention.

FIG. 5 is a side cut-away view thereof;

FIG. 6A is a bottom view thereof;

FIG. 6B is a bottom view thereof showing the adaptor in a raised position; and FIG. 7 is a close-up bottom view of the adaptor of the present invention.

In the detailed description that follows, like element numerals are used to describe like elements in one or more of the figures.

DETAILED DESCRIPTION OF THE PREFERRED EMBODIMENT

Referring first to FIGS. 1 and 2, there is shown a slide bar assembly 100 according to the present invention. The assembly is formed from an elongated bar member 110 and an adaptor 120. The adaptor includes a slider 122 that slides along the bar member 110 and a holder 125 designed to hold a weighted item such as a container or other holder. As will be further described below, the adaptor 120 can be adjusted to either slide along the bar 110 or remain in a fixed position therealong.

The elongated bar member 110 may have any cross-sectional shape, but preferably is generally cylindrical. Since the slide bar assembly is particularly suited for shower and bath use, the bar member 110 is preferably formed from a light, rust-proof material, such as stainless steel or plastic, although any other metallic or polymeric material having sufficient strength may be used as well. In addition, the material used in forming the bar member 110 should be capable of creating a friction force with respect to the adaptor 120.

The bar member 110 preferably is mounted on a building structure such as a wall or ceiling. The bar member 110 may be mounted using any coupling devices, such as adhesives, screws, mounting brackets, rails or the like.

The adaptor 120 is preferably formed of plastic or other material and includes two portions, a slider 122 and a holder 125. The slider is designed to slide along the bar member 110. The holder 125 is used to hold a storage container or other item.

Referring to FIG. 1, the holder 122 of the adaptor defines two generally cylindrical apertures, i.e., bores 145, 150. The circumference of both bores should be slightly larger than the circumference of the bar member 110 so as to allow the adaptor to move along the bar member 110. A first bore 145 is made in a vertical direction through the slider 122 of the adaptor 120. When an item is attached to the holder 125 of the adaptor 120, friction between the bar 110 and the adaptor 120 holds the adaptor in place along the bar. An elastomer strip 130 may also be placed along the inner edge of the adaptor formed by the first bore. The elastomer strip 130 interacts with the bar member 110 to further increase friction between the adaptor 120 and the bar member 110 when an item is attached to the holder 125.

As shown in FIGS. 3*a* and 3*b*, a second bore 150 is defined in the slider 122 of the adaptor 120 at a fixed angle with respect to the first bore 145. The preferred angular displacement of the two bores is 15°, however any angular displacement may be used which will allow the adaptor 120 to lock in place when using the first bore 145, and to move freely along the bar member 110. When an item is attached to the holder 125 of the adaptor 120, the adaptor can be lifted to place the second bore along the bar member 110. The adaptor can then easily slide along the bar member 110.

The holder 125 is preferably linked to the slider 122 and is coupled with an item for storage. For instance, with reference to FIGS. 1 and 2, both the slider 122 and the holder 125 may be formed from a single unit and disposed opposite one another. The second portion 125 may include a cylindrical extension that extends vertically beneath the adaptor. The extension may include several snaps 135 that are used to couple with a storage item. Other similar methods may bee used to couple the second portion with a storage item.

FIGS. 4–7 show a second embodiment of the slide bar assembly 200 of the present invention. In this embodiment, the assembly 200 similarly includes an elongated bar member 210 and an adaptor 220 having a first portion 222 that slides along the bar member 210 and a second portion 225 for coupling with an item for storage.

The elongated bar member 210 is generally rectangular having four generally vertical sides 212, 214, 216, 218. The bar member 210 may be formed of material similar to that used in the first embodiment. Semi-cylindrical indentations 250 are formed into the center of side edges 214, 218, respectively, of the bar member 210, so as to form a track that allows adaptor 220 to slide along the bar member 210.

The adaptor 220 includes a slider 222 and a holder 225. The slider 222 is formed by removing a generally rectangular section of the adaptor 220 having a width slightly larger than the width of the bar member 210. The inner surface of the first portion 222 matches the contours of the bar member 210. Two projections 235A, 235B are formed on side inner edges of the holder 222 of the adaptor 220. Interferences ribs 240 also are formed along side inner edges of the holder 222. The interference ribs provide friction when the adaptor 220 is in a non-horizontal position relative to the bar member 210 (as shown in FIGS. 6*a* and 6*b*), so as to lock the adaptor in place. The holder 225 of the adaptor 220 is similar in construction to the holder 125 of the adaptor 120 of the first embodiment, and is described above.

Having thus described preferred embodiments of the slide bar assembly of the present invention, it should be apparent to those skilled in the art that certain advantages of the within system have been achieved. It should also be appreciated that various modifications, adaptations, and alternative embodiments thereof may be made within the scope and spirit of the present invention. The invention is further defined by the following claims.

What is claimed is:

1. A slide bar assembly comprising:

an elongated bar member;

an adaptor having a slider portion slidably retained along the bar member and a holder portion integrally formed with the slider portion;

a first bore disposed vertically through the slider portion of the adaptor, the first bore permitting passage of the elongated bar member; and a second bore permitting passage of the bar member and immediately adjacent to the first bore, the second bore being formed at a predetermined acute angular distance from the first bore.

2. The slide bar assembly as recited in claim 1, wherein the bar member is generally rectangular.

3. The slide bar assembly as recited in claim 2, wherein the bar member includes a plurality of side edges having indentations therein.

4. The slide bar assembly as recited in claim 1, wherein the bar member is generally cylindrical.

5. The slide bar assembly as recited in claim 1, wherein the slider portion of the adaptor further comprises an elastomer strip.

6. The slide bar assembly as recited in claim 1, further comprising:

holding means, coupled to the holder portion of the adaptor, for holding an item.

7. The slide bar assembly as recited in claim 6, wherein the holding means comprises:

a cylindrical extension formed along a bottom of the holding portion of the adaptor; and a plurality of snaps formed around the extension.

8. The slide bar assembly as recited in claim 1, wherein the second bore is formed 15 degrees from the first bore.

9. A slide bar assembly comprising:

an elongated bar member having a plurality of side edges, each side edge having an indentation formed therein;

an adaptor having a slider portion and a holder portion coupled to the slider portion; and a plurality of projections coupled to the slider portion and slidably retained within the indentations.

10. The slide bar assembly as recited in claim 9, wherein the bar member is composed of plastic.

11. The slide bar assembly as recited in claim 9, wherein the bar member is formed of metal.

12. The slide bar assembly as recited in claim 9, further comprising:

holding means, coupled to the holder portion of the adaptor, for holding an item.

13. The slide bar assembly as recited in claim 12, wherein the holding means comprises:

a cylindrical extension formed along a bottom of the holder portion of the adaptor; and a plurality of snaps formed around the extension.

14. A shower bar assembly comprising:

a bar;

an adaptor coupled to the bar;

a first bore disposed vertically through the adaptor, the first bore permitting passage of the bar;

a second bore permitting passage of the bar and immediately adjacent to the first bore, the second bore being formed at a predetermined acute angular distance from the first bore; and means for holding an accessory, the holding means being coupled to the adaptor.

15. A slide bar assembly comprising:

an elongated bar member;

an adaptor slidably retained along the bar member by at least one of a first bore disposed vertically therethrough and a second bore immediately adjacent to the first bore and formed at a predetermined acute angular distance to the first bore; and means for holding an item, the holding means integrally formed with the adaptor.

* * * * *